US006127104A

United States Patent [19]

Droin et al.

[11] Patent Number: 6,127,104

[45] Date of Patent: Oct. 3, 2000

[54] REVERSAL PHOTOGRAPHIC FILM FOR DISPLAYS

[75] Inventors: Gerard M. Droin, Beaune; Yannick Begel, Chalon sur Saone; Didier M. Chigot, Chalon-sur-Saone, all of France

[73] Assignee: Eastman Kodak Company, Rochester, N.Y.

[21] Appl. No.: 09/103,155

[22] Filed: Jun. 22, 1998

[30] Foreign Application Priority Data

Jun. 25, 1997 [FR] France ..... 97 08299

[51] Int. Cl.[7] ..... G03C 1/492

[52] U.S. Cl. ..... 430/512; 430/507; 430/506; 430/505; 430/933; 430/533; 430/536

[58] Field of Search ..... 430/933, 512, 430/640, 642, 503, 505, 506, 507, 533, 536

[56] References Cited

U.S. PATENT DOCUMENTS

| | | | |
|---|---|---|---|
| 4,447,524 | 5/1984 | Uno et al. | 430/536 |
| 4,587,208 | 5/1986 | Kadowaki et al. | 430/512 |
| 4,859,539 | 8/1989 | Tomko et al. | 430/517 |
| 4,960,685 | 10/1990 | Bowne | 430/505 |
| 4,980,274 | 12/1990 | Tai et al. | 430/533 |
| 5,480,767 | 1/1996 | Tosaka et al. | 430/358 |
| 5,683,861 | 11/1997 | Vishwakarma et al. | 430/512 |
| 5,731,136 | 3/1998 | Schmuck | 430/512 |
| 5,876,914 | 3/1999 | Droin et al. | 430/503 |
| 5,888,681 | 3/1999 | Gula et al. | 430/20 |
| 5,932,401 | 8/1999 | Chen | 430/504 |
| 5,932,406 | 8/1999 | Adegawa et al. | 430/531 |

FOREIGN PATENT DOCUMENTS 3800130 7/1988 Germany .

*Primary Examiner*—Janet Baxter
*Assistant Examiner*—Amanda C. Walke
*Attorney, Agent, or Firm*—Andrew J. Anderson

[57] ABSTRACT

The present invention concerns a novel film for light boxes, in particular a reversal film for light box displays comprising a transparent support covered, in order, with a red-sensitive silver halide emulsion layer, a green-sensitive silver halide emulsion layer and a blue-sensitive silver halide emulsion layer, the support being covered on at least one of its faces with a layer comprising an opacifying compound in a quantity such that the minimum density of the film is between 0.2 and 0.6. This film also has compatibility with existing processing methods intended for reversal photographic products.

12 Claims, No Drawings

REVERSAL PHOTOGRAPHIC FILM FOR DISPLAYS

FIELD OF THE INVENTION

The present invention concerns a novel film for light boxes, in particular a reversal film for displays.

BACKGROUND OF THE INVENTION

In conventional color photography, the photographic products contain three superimposed units of layers of silver halide emulsions, one to form a latent image corresponding to exposure to blue light (blue sensitive), one to form a latent image corresponding to exposure to green and one to form a latent image corresponding to exposure to red.

During the photographic processing, the developing agent reduces the silver ions of each latent image. The developing agent oxidized during this reaction then reacts in each unit with a dye-forming coupler in order to produce yellow, magenta and cyan dye images respectively from the recordings in blue, green and red. This produces negative dye images.

The reversal photographic products which give positive images comprise the three same superimposed units of layers of silver halide emulsion, each of these units containing respectively a yellow, magenta and cyan dye-forming coupler. After exposure, these reversal photographic products are subjected to a first black and white development (development of the latent image) and then to a reversal step which is either chemical or through a further fogging exposure which makes developable the silver halides which were not initially exposed. After reversal, the photographic product is processed in a color development bath in the presence of couplers, generally contained in the photographic product.

In the art it is known that silver halide photographic films can be used for making advertising media (posters) which can be used as displays. These films, after having been exposed and developed are exposed on high-intensity light, the image being continuously illuminated. For example, the photographic product DURATRANS® manufactured by Kodak® requires the use of a negative/positive system of the Ektacolor® type, that is to say the DURATRANS® film is a film for a light box which requires the use of a negative original image. For obtaining a film for displays from a transparency, it is necessary to perform an intermediate trial on an intermediate negative film in order to obtain the final positive print for the light box. In addition, this system has the drawback of not being totally compatible with the standard sequence of the Ektacolor® processing method currently used in processing laboratories. In particular, the duration of each processing step must be modified with respect to the standard durations, which makes its use unsuited to automated processing.

There also exists a film for displays intended for a method of processing by local destruction of dyes in the presence of a silver image known as "silver dye bleach". This method is used with photographic film on which the layers of silver halide emulsion are initially colored by means of a cyan, magenta and yellow non-diffusing dye. During the development, three superimposed negative silver images are formed, embedded in the mass of three dyes. In order to have a colored image in each layer, it is necessary to destroy the dye, proportionally to the quantity of silver present locally. The duration of the photographic development with such a method is greater than 10 minutes.

Having regard to the existing photographic films for displays, it is desirable to develop a novel photographic film for light boxes which does not present the drawbacks of the known films. In particular, it is desirable to have a novel film for light boxes using reversal technology which is also entirely compatible with conventional processing methods.

SUMMARY OF THE INVENTION

The present invention concerns a color reversal photographic film for displays comprising a transparent support covered, in order, with a red-sensitive silver halide emulsion layer, a green-sensitive silver halide emulsion layer and a blue-sensitive silver halide emulsion layer, the support being covered on at least one of its faces with a layer comprising an opacifying compound in a quantity such that the minimum density of the film is between 0.2 and 0.6.

The invention provides a novel film for light boxes using reversal technology which is also entirely compatible with conventional processing methods.

DETAILED DESCRIPTION OF THE INVENTION

According to a particular embodiment, the reversal film of the present invention comprises a transparent support covered on one of its faces, and in the following order, with a red-sensitive silver halide emulsions layer, a green-sensitive silver halide emulsion layer and a blue-sensitive silver halide emulsion layer, and on the other face of the support with a layer comprising the opacifying compound in a quantity such that the minimum density of the film is between 0.2 and 0.6.

In the context of the invention, the minimum density (Dmin) of the film is the optical density of the support and of the fog obtained after exposure and development of the film by a color reversal process. Reversal films meeting the minimum density requirement of the invention enable effective image displays when used with light boxes, wherein the light box light source cannot be seen by viewers.

Silver halide color reversal films in accordance with the invention are distinguished from color negative films and print elements in that they are typically associated with an indication for processing by a color reversal process. Reference to a film being associated with an indication for processing by a color reversal process most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6" or "Ektachrome® R-3". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film). In a typical construction, a reversal film does not have any masking couplers. Furthermore, reversal films have a gamma which is generally higher than the gamma for typical negative origination materials and lower than that for negative print materials.

The reversal film for displays of the present invention is advantageously compatible with the KODAK Ektachrome R-3® process currently used in photographic processing laboratories so as to provide minimum densities in accordance with the invention when processed with standard Ektachrome R-3 processing. Reversal films in accordance with the invention no longer require the use of an intermediate film in preparing image copies for display on light boxes when the original image is a transparency. In addition, this film has improved sensitometric properties and in particular makes it possible to obtain better details in the dark areas of the photographic image.

In the context of the present invention, the opacifying compound is a photographically inert white pigment. This pigment can for example be titanium oxide, titanium dioxide, silicon dioxide, barium sulphate etc.

In a preferred embodiment, the opacifying compound is titanium oxide in a quantity lying between 0.5 and 8.0 g/m$^2$ and preferably between 1.0 and 6.0 g/m$^2$.

According to a particular embodiment, the opacifying layer comprises a binder in which the opacifying compound is dispersed. This binder is generally a hydrophilic compound alone or associated with other polymer substances. Conventionally the binder is gelatin.

In the context of the invention, it is advantageous to introduce into the photographic film an ultraviolet-absorbent agent in efficient quantity, these films being constantly subjected to a high exposure to light. Such agents are known in photography. They are for example benzotriazoles, substituted dicyanobutadienes, aminodicyanobutadiene, acetylenic compounds, substituted styrenes, hydroxy phenyl benzotriazoles or triazoles. Ultraviolet-adsorbent agents useful for the invention are cited in Research Disclosure, September 1994, number 36544 (referred to in the remainder of the description as *Research Disclosure*) Sections IV(1), VIII B(2).

According to a particular embodiment, the ultraviolet-absorbent agent is present in the silver halide emulsion layer which is furthest away from the support. In another embodiment, the reversal film of the present invention also comprises a protective layer situated above the layers of silver halide emulsions, this protective layer containing an ultraviolet-absorbent agent. When the ultraviolet-absorbent agent is present either in the silver halide emulsion layer which is furthest away from the support or in the protective layer, it is generally present in a quantity between 0.4 and 0.8 g/m$^2$. In a third embodiment, the ultraviolet-absorbent agent is situated on the face of the support opposite to the face covered by the silver halide emulsions (the back layer). In this case, the quantity of ultraviolet-absorbent agent is between 0.5 and 2 g/m$^2$. The ultraviolet-absorbent agent can be present in several of the layers described above. According to a particular embodiment, the ultraviolet-absorbent agent is present in the protective layer and in the back layer.

The support can be any support transparent to visible light which is suitable for photographic products. Conventional supports comprise polymer films. Polymer films which can be used are described in *Research Disclosure*, Section XV. The supports which are most often used are for example colorless polyester (e.g., Estar®) or triacetate polymer films.

The photographic films of the invention can contain other layers which are conventional in photographic products, such as spacing layers, filter layers and antihalation layers.

The preparation of light-sensitive silver halide emulsions which can be used in the film of the present invention is described in *Research Disclosure*Section I.

The silver halide emulsions are chemically sensitized according to methods which are conventional in photography, described in Section IV of *Research Disclosure.* The chemical sensitizers generally used are compounds of sulfur and/or selenium and/or gold. It is also possible to use sensitization by reduction.

The silver halide emulsions generally consist of silver halide grains dispersed in a binder, generally hydrophilic colloids, used alone or in combination with other polymeric substances (for example latexes). Such binders are described in detail in *Research Disclosure,* Section II.

The emulsions can be polydisperse or monodisperse. Each of the layers of silver halide emulsions can contain one or more types of emulsion. For example, the layers of emulsion can contain a mixture of emulsions having different grain sizes and/or dispersities.

Each layer of silver halide emulsion of the film of the invention is spectrally sensitized in part of the light spectrum. The spectral sensitization, or chromatisation, methods are described in the same publication, Section V.

The photographic films of the invention can contain, among other things, optical brighteners, antifog compounds, surfactants, plasticizers, lubricants, tanning agents, stabilizers, absorption and/or diffusion agents as described in Sections VI, VII and VIII of the above mentioned *Research Disclosure.*

The reversal films of the present invention, after being exposed, are developed with a photographic process which comprises a silver development of the latent image (black and white development), a reversal step, a color development, in the presence of a color developing agent and a coupler, the coupler being present either in the color bath or in the photographic product. The photographic films are then washed, subjected to a bleaching bath and then a fixing bath. They can then be processed in a stabilizing bath. The bleaching bath and fixing bath can be replaced by a single bleaching/fixing bath.

The silver development takes place in the presence of a reducing compound which transforms the exposed silver halide grains into metallic silver. These compounds are for example dihydroxybenzenes such as hydroquinone, 3-pyrazolidinones, aminophenols, etc.

The reversal step consists of making the remaining unexposed silver halide grains developable either by a fogging exposure or by contact with a fogging substance, such as a tin salt.

The color developer contained in the color development bath which makes it possible to obtain the color image is in general an aromatic primary amine such as the p-phenylenediamines.

The main compound of the bleaching bath is an oxidizing compound which converts the metallic silver into silver ions such as, for example, alkali metal salts of a ferric complex of an aminocarboxylic acid, or persulphate compounds. The bleaching compounds normally used are the ferric complexes of nitrolotriacetic acid, ethylenediamine tetraacetic acid, 1,3-propylenediamine tetraacetic acid, triethylenetriamine pentaacetic acid, ortho-diaminocyclohexane tetraacetic acid, ethyliminodiacetic acid etc.

The fixing bath enables the silver halide to be completely converted into a soluble silver complex which is then eliminated from the layers of the photographic product by washing. The compounds used for fixing are, for example, thiosulphates, such as ammonium or alkali metal thiosulphates. Stabilizing agents and chelating agents can be added to the fixing bath.

In the following examples, the photographic product is a color reversal film which is exposed and then processed according to the standard operating method of the Ektachrome® R-3 process.

EXAMPLES

Example 1

Invention

A color reversal photographic film for displays was prepared having the following structure:

| | |
|---|---|
| Layer 1 | Protective top layer containing a 50/50 bromochloride emulsion with fine grains non sensitive to light |
| Layer 2 | Blue-sensitive layer comprising:<br>a polydisperse emulsion (35% by weight) AgBrI (3.4% mol I), ECD = 1 μm;<br>a core/shell emulsion (65% by weight) AgBrI (3.7% mol I) with octahedral grains, ECD = 0.73 μm;<br>Yellow dye-forming coupler COUP - 1<br>Blue-sensitive spectral sensitizing dye COL - 1<br>Ultraviolet-absorbent agent (0.5 g/m$^2$) UV-1<br>Silver content (0.7 g/m)<br>Gelatin content (2.1 g/m) |
| Layer 3 | Filter layer comprising yellow colloidal silver (0.15 g/m ) and gelatin (1.2 g/m$^2$) |
| Layer 4 | Green-sensitive layer comprising:<br>a polydisperse emulsion (35% by weight) (AgBrI (3.4% mol I), ECD = 1 μm;<br>a core/shell emulsion (30% by weight) AgBrI (3.7% mol I) with octahedral grains, ECD = 0.8 μm;<br>a core/shell emulsion (24% by weight) AgBrI (3.7% mol I) with octahedral grains, ECD = 0.5 μm;<br>a core/shell emulsion (11 % by weight) AgBrI (3.7% mol I) with octahedral grains, ECD = 0.55 μm;<br>Magenta dye-forming coupler (COUP-2)<br>Green-sensitizing spectral dye (COL-2)<br>Silver content (0.8 g/m$^2$)<br>Gelatin content (0.6 g/m$^2$) |
| Layer 5 | Layer containing gray colloidal silver (0.05 g/m$^2$) and gelatin (0.8 g/m$^2$) |
| Layer 6 | Red-sensitive layer comprising:<br>a core/shell emulsion (6% by weight) AgBrI (3.7% mol I) with octahedral grains, ECD = 1.15 μm;<br>a core/shell emulsion (53% by weight) AgBrI (3.7% mol I) with octahedral grains, ECD = 0.6 μm;<br>a core/shell emulsion (41% by weight) AgBrI (3.7% mol I) with octahedral grains, ECD = 0.5 μm;<br>Cyan dye-forming coupler (COUP-3)<br>Red-sensitizing spectral dye (COL-3)<br>Silver content (0.4 g/m$^2$)<br>Gelatin content (2.3 g/m$^2$)<br>Hardening agent (bisvinylmethylsulphone) 1.05% by weight of gelatin |
| Support | Colorless Estar ® support |
| Layer 7 | Layer comprising gelatin (4.5 g/m$^2$), titanium oxide (2.6 g/m$^2$) and ultraviolet-absorbent agent (UV-1) (1.5 g/m$^2$) |
| Layer 8 | Layer of gelatin (1 g/m$^2$) |

"ECD" in the above structure description stands for the average equivalent circular diameter of the emulsion grains, where the equivalent circular diameter of a grain is the diameter of a circle having an area equal to the projected area of the grain. The spectral dyes and couplers used in the above film are described below:

Blue-sensitizing spectral dye COL-1:
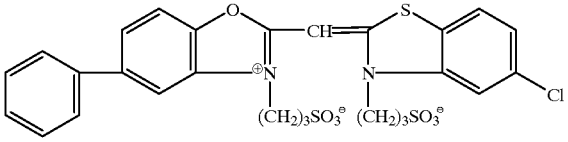
Green-sensitizing spectral dye COL-2:
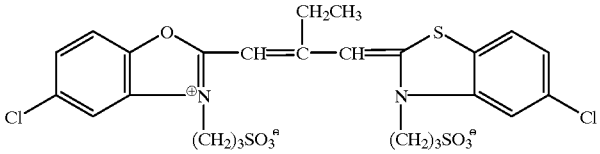
Red-sensitizing spectral dye COL-3:
mixture of
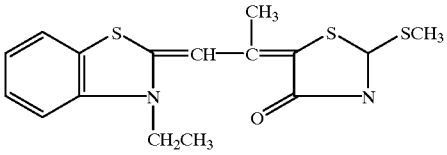
and
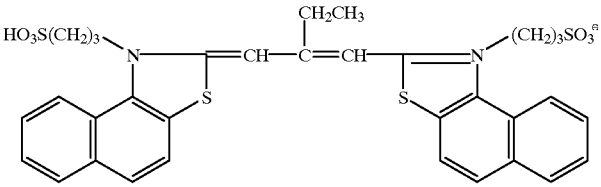
Yellow dye-forming coupler COUP-1:
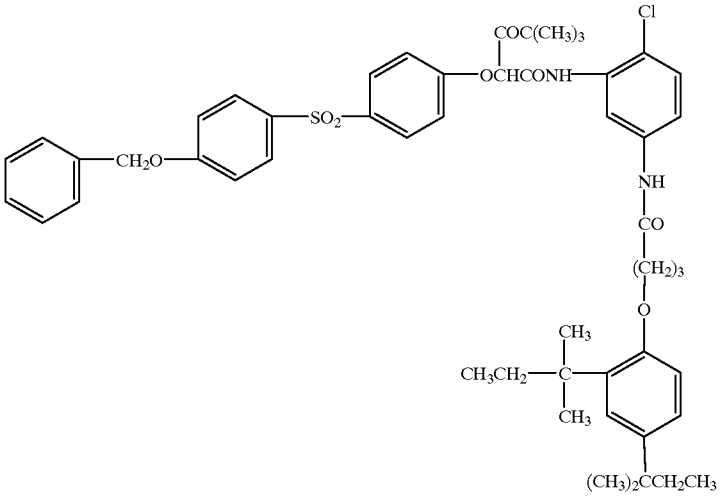
Magenta dye-forming coupler COUP-2:
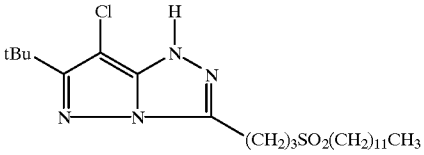
Cyan dye-forming coupler COUP-3:
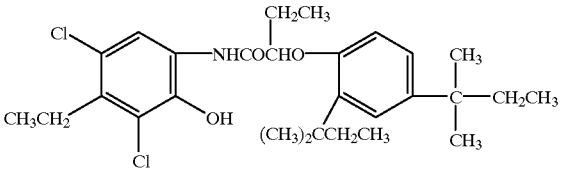

-continued

Ultraviolet-absorbent compound (UV-1):

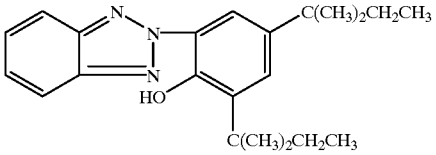

A sample of the photographic product described above was exposed with a tungsten lamp (color temperature 2850° K) for ½ second through a neutral sensitometric wedge.

After exposure, these samples were treated in an AUTOPAN® automatic processing machine comprising conventional baths for the KODAK® Ektachrome® R-3 process, and read for STATUS A densitometry results.

The standard Ektachrome® R-3 process comprises the following steps:

| | |
|---|---|
| Black and white development | 1 min 15 |
| Washing | 1 min 30 |
| Re-exposure | |
| Color development (38° C.) | 2 min 15 |
| Washing | 0 min 45 |
| Bleaching/fixing | 2 min |
| Washing | 2 min 15 |

| | Red | Green | Blue |
|---|---|---|---|
| Dmin | 0.32 | 0.37 | 0.37 |
| Dmax | 3.5 | 3.5 | 3.5 |
| Contrast | 0.86 | 0.84 | 0.84 |

The maximum density (Dmax) corresponds to the density of an unexposed area.

The minimum density (Dmin) is represented by the density at an exposure 1.6 Log E greater than the exposure giving a density of 0.8.

The contrast is represented by the slope between the density at an exposure 0.5 Log E less than the exposure giving a density of 0.8 and the density at an exposure 0.3 Log E greater than the exposure giving a density of 0.8.

The invention has been described in detail with particular reference to certain preferred embodiments thereof, but it will be understood that variations and modifications can be effected within the spirit and scope of the invention.

What is claimed is:

1. Color-reversal photographic film for displays comprising a support transparent to visible light covered on one of its faces, in order with a red-sensitive silver halide emulsions layer, a green-sensitive silver halide emulsion layer and a blue-sensitive silver halide emulsion layer, the support being further covered on the other face with a layer containing an opacifying compound dispersed in a hydrophilic compound in a quantity such that the minimum density of the film is between 0.2 and 0.6.

2. Reversal film according to claim 1, wherein the silver halide emulsion layer which is furthest away from the support comprises an ultraviolet-absorbent agent.

3. Reversal film according to claim 1, also comprising a protective layer for the silver halide emulsion layers situated above the silver halide emulsion layers which contains an ultraviolet-absorbent agent.

4. Reversal film according to claim 1, comprising an additional layer containing an ultraviolet-absorbent agent which is situated on the face of the support opposite to the face covered by the silver halide emulsions.

5. Reversal film according to claim 1, wherein the support is a polyester polymer support.

6. Reversal film according to claim 1, wherein the opacifying compound is titanium oxide in a quantity between 0.5 and 8 g/m$^2$.

7. Reversal film according to claim 1, wherein the minimum density of the film is the optical density of the support and of the fog obtained upon exposure and development of the film by the KODAK Ektachrome R-3® color reversal process.

8. Reversal film according to claim 7, wherein the silver halide emulsion layer which is furthest away from the support comprises an ultraviolet-absorbent agent.

9. Reversal film according to claim 7, also comprising a protective layer for the silver halide emulsion layers situated above the silver halide emulsion layers which contains an ultraviolet-absorbent agent.

10. Reversal film according to claim 7, comprising an additional layer containing an ultraviolet-absorbent agent which is situated on the face of the support opposite to the face covered by the silver halide emulsions.

11. Reversal film according to claim 7, wherein the support is a polyester polymer support.

12. Reversal film according to claim 7, wherein the opacifying compound is titanium oxide in a quantity between 0.5 and 8 g/m$^2$.

* * * * *